US007743953B2

(12) United States Patent
Okazaki et al.

(10) Patent No.: US 7,743,953 B2
(45) Date of Patent: Jun. 29, 2010

(54) BRASSIER WASHING UTENSIL

(76) Inventors: Yoshiki Okazaki, c/o Okazaki Sangyo Co., Ltd., 781-1, Shirahama-cho Ko, Himeji-shi, Hyogo 6728023 (JP); Kazuyo Okazaki, c/o Okazaki Sangyo Co., Ltd., 781-1, Shirahama-cho Ko, Himeji-shi, Hyogo 6728023 (JP)

( * ) Notice: Subject to any disclaimer, the term of this patent is extended or adjusted under 35 U.S.C. 154(b) by 144 days.

(21) Appl. No.: 12/081,576

(22) Filed: Apr. 17, 2008

(65) Prior Publication Data

US 2008/0296322 A1 Dec. 4, 2008

(30) Foreign Application Priority Data

Apr. 17, 2007 (JP) ..... 2007-002714

(51) Int. Cl.
*D06C 15/00* (2006.01)

(52) U.S. Cl. ..... 223/84; 223/85; 206/278

(58) Field of Classification Search ..... 223/1, 223/57, 66, 84, 85, 88; 206/278, 292
See application file for complete search history.

(56) References Cited

U.S. PATENT DOCUMENTS

| | | | | |
|---|---|---|---|---|
| 2,089,266 | A * | 8/1937 | Kalvin | 223/66 |
| 2,815,157 | A * | 12/1957 | Badgley | 223/66 |
| 3,837,476 | A * | 9/1974 | Schwartz | 206/278 |
| 5,320,429 | A * | 6/1994 | Toyosawa | 383/117 |
| 5,556,013 | A * | 9/1996 | Mayer | 223/84 |
| 5,829,083 | A * | 11/1998 | Sutton | 8/150 |
| 5,971,236 | A * | 10/1999 | DesForges et al. | 223/84 |
| 6,234,368 | B1 * | 5/2001 | DesForges et al. | 223/84 |
| 6,471,102 | B2 * | 10/2002 | Hancock | 223/84 |
| 6,742,683 | B1 * | 6/2004 | Phan | 223/84 |
| 6,973,808 | B2 * | 12/2005 | Peska | 68/235 R |
| 7,163,605 | B2 * | 1/2007 | Chen | 206/292 |
| 7,350,679 | B2 * | 4/2008 | Radtke et al. | 223/84 |
| 2007/0056997 | A1 * | 3/2007 | Radtke et al. | 223/84 |

FOREIGN PATENT DOCUMENTS

| | | |
|---|---|---|
| JP | 62-199076 U | 12/1987 |
| JP | 3111045 U | 5/2005 |
| JP | 3114798 U | 9/2005 |

* cited by examiner

*Primary Examiner*—Gary L Welch
*Assistant Examiner*—Nathan E Durham
(74) *Attorney, Agent, or Firm*—Smith Patent Office

(57) ABSTRACT

A brassiere holder is presented that includes two cup receiving portions, a connecting portion and a hook portion. When the cup receiving portions are pressed from the side, the connecting portion is elastically deformed to allow the two cup receiving portions to be folded back on each other such that a part of a flange portion of the two cup receiving portions is brought into contact with the other part of the flange portion and a gap gradually increasing toward the upper side is formed between the two cup receiving portions. In this manner, since the cup portions of the brassiere are formed in a shape similar to a shape obtained in a state in which a three-dimensional shape of a breast of a human being is folded into two, the cup portions are positioned as they are under their current state and are put in a soft net bag.

3 Claims, 8 Drawing Sheets

BRASSIER WASHING UTENSIL

FIELD OF THE INVENTION

The present invention relates to a brassiere washing utensil, and more particularly to a hanger set adapted to wash, dry, and store a brassiere without loss of shape in cup portions, damage of fabric such as lace and cloth, and deformation and twisting of wires.

BACKGROUND OF THE INVENTION

Generally, a brassiere is made of flexible and delicate fabric such as lace and cloth because it directly comes into contact with a soft and sensitive breast of a woman. When such a brassiere is put in a washing machine as it is, and then washed, loss of shape in brassiere cup portions for covering a breast may occur and wires inserted into the lower peripheral edges of the cup portions may be deformed and twisted.

Accordingly, there is proposed a washing aid (JP-UM-A-62-199076) having a configuration in which two bowl-shaped cup receiving portions foldably connected to each other by a connecting pin cover two cup portions of a brassiere, are folded back on each other to put shoulder strips and under-belts of the brassiere inside thereof, and are put in a net bag, and then a strip of the mouth edge of the net bag is fastened to put the net bag in a washing machine. In this washing aid, since the brassiere is fastened by the net bag, displacement of the brassiere from the cup receiving portions by the strong flow of water during washing does not occur.

However, the cup receiving portions are simply folded back on each other and then fastened by the net bag. Accordingly, when the brassiere is covered with the cup receiving portions and the cup receiving portions are folded without disregard to a three-dimensional shape of a breast of a human being, that is, a three-dimensional shape of the brassiere, a tensile force in an outward direction is applied to the lower portions of the cup portions of the brassiere and the other portions are raised from the cup receiving portions. In such a state, flexible and delicate fabric of the brassiere may be damaged when the brassiere is put in the net bag, tightened and washed.

In addition, there is proposed a hanger set (Japanese Utility Model No. 3,111,045 and Japanese Utility Model No. 3,114,798) configured by a brassiere holder which includes at least two cup receiving portions covering cup portions of a brassiere to keep three-dimensional shapes of the cup portions to thereby minimize loss of shape, a connecting piece portion connecting the two cup receiving portions with each other, and a hook provided in the connecting piece portion and hooking an area between the cup portions of the brassiere, is stored in a drawer, and makes it difficult to occur loss of shape when being carried for a trip, and a hanger removably holding the brassiere holder.

DISCLOSURE OF THE INVENTION

In view of such a situation, an object of the invention is to provide a brassiere washing utensil adapted to safely wash, dry, and store a brassiere without loss of shape in cup portions, damage of fabric and deformation and twisting of wires.

Accordingly, a brassiere washing utensil according to the invention, capable of keeping a shape of a brassiere during washing, includes a brassiere holder and a soft net bag. The brassiere holder includes 1) two cup receiving portions which are made of a soft and elastic restorative material in a bowl shape and have a plurality of holes or slits formed in the bowl-shaped portions and for applying air and water permeabilities and a flange portion formed at the lower peripheral edges of the bowl-shaped portions, cup portions of the brassiere are being covered with the bowl-shaped portions, the lower peripheral edges of the cup portions being received by the flange portion, and shoulder strips and under-belts of the brassiere being accommodated inside the bowl-shaped portions; 2) a connecting portion which connects the two cup receiving portions to each other and is elastically deformed by a pressing force from the side to allow the two cup receiving portions to be folded back on each other such that a part of the flange portion of the two cup receiving portions is brought into contact with the other part of the flange portion and a gap gradually increasing toward the upper side is formed between the two cup receiving portions; and 3) a hook portion which is formed in the connecting portion and hooks the brassiere to position the cup portions of the brassiere with respect to the cup receiving portions. The soft net bag is formed in a net shape made of a washable material, accommodates the brassiere holder in which the two cup receiving portions are folded back on each other, and elastically holds the cup portions of the brassiere in a gap with the bowl-shaped portions by an elastic restorative force of the bowl-shaped portions of the cup receiving portions to keep three-dimensional shapes of the cup portions of the brassiere and wires of the lower peripheral edges thereof.

A main characteristic of the invention is that when the connecting portion is elastically deformed by pressing from the side such that the cup receiving portions are folded back on each other, a part of the flange portion of the two cup receiving portions is brought into contact with the other part of the flange portion and a gap gradually increasing toward the upper side is formed between the two cup receiving portions.

When being folded back on each other as described above, the two cup receiving portions are formed in a shape similar to a shape obtained in a state in which a three-dimensional shape of a breast of a human being is folded into two and thus the cup portions of the brassiere are fitted to the cup receiving portions while keeping their three-dimensional shapes.

In addition, a second characteristic of the invention is that the brassiere can be hooked by the hook portion when the cup portions of the brassiere are covered with the cup receiving portions.

In this manner, the cup portions of the brassiere can be positioned with respect to the cup receiving portions and thus the brassiere can be folded into two while keeping the three-dimensional shapes of the cup portions. And in such a state, the brassiere is accommodated inside the soft net bag. Accordingly, in washing of the brassiere, an excessively high load does not act on the brassiere, loss of shape in the cup portions and deformation and twisting of the wires do not occur, and flexible and delicate fabric for the brassiere is not damaged.

The cup receiving portions and the connecting portion of the brassiere holder may be made of a soft and elastic restorative material. For example, a soft synthetic resin material can be used in addition to thermoplastic elastomer. The hook portion may be made of a material capable of holding the cup portions of the hooked brassiere. At the same time, the hook portion is preferably made of a soft material so as not to damage the cup portions of brassiere. For example, a synthetic resin material can be used in addition to thermoplastic elastomer.

The soft net bag may be adapted to accommodate the folded brassiere holder. For example, woven or nonwoven fabric or a soft synthetic resin material can be used.

Further, the soft net bag may be formed in a shape capable of accommodating and fastening the folded brassiere holder. For example, the soft net bag may be formed in a three-dimensional shape similar to the three-dimensional shape of the brassiere holder when the cup receiving portions are folded back on each other, and can be opened and closed by a fastener.

As described above, since loss of shape during washing can be prevented, loss of shape during drying also can be suppressed.

Accordingly, the brassiere washing utensil may further include a hanger having a configuration in which both end portions of a receiving arm are rotatably supported to both side portions of a hanger main body. An engaging hole may be formed in the connecting portion of the holder and an engaging protrusion capable of being fitted to the engaging hole of the holder may be formed in the receiving arm.

Both the end portions of the receiving arm may be constituted such that the two cup receiving portions of the holder are held so as to face the upper side.

BEST MODE FOR CARRYING OUT THE INVENTION

Figure 1:
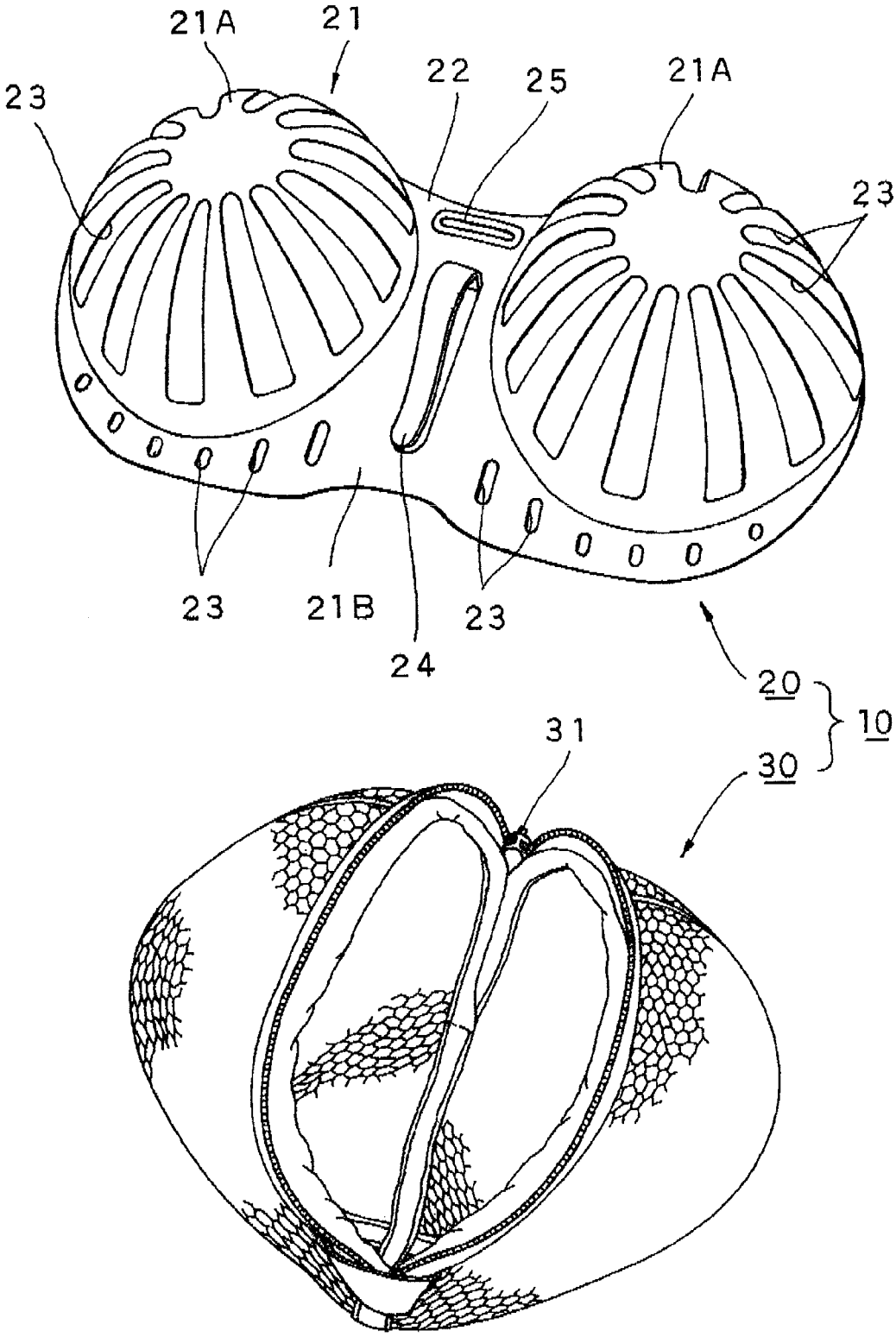
FIG. 1 is a perspective view schematically illustrating a holder and a soft net bag in a preferable embodiment of a brassiere washing utensil according to the invention.

Hereinafter, the invention will be described in detail on the basis of the specific examples illustrated in the drawings. FIGS. 1 to 8 illustrate a preferable embodiment of a brassiere washing utensil according to the invention. In this example, the brassiere washing utensil 10 is configured by a brassiere holder 20 and a soft net bag 30.

By using a soft and elastic restorative material, for example, a thermoplastic elastomeric resin, the brassiere holder 20 is injection-molded in a shape in which two cup receiving portions 21 are connected by a connecting portion 22. The cup receiving portions 21 has bowl-shaped portions 21A for covering cup portions 41 of a brassiere 40 and a flange portion 21B is formed in the lower portions of the cup receiving portions 21 and the connecting portion 22.

A plurality of slits 23 are formed in the bowl-shaped portions 21A and the flange portion 21B, thereby applying air and water permeabilities to the holder 20.

Further, in the connecting portion 22, a hook portion 24 is formed between the two cup receiving portions 21 so as to be cut and raised. An area between the two cup portions 41 of the brassiere 40 is hooked on the hook portion 24 so as to position the cup portions 41 of the brassiere 40 with respect to the cup receiving portions 21.

A long groove-shaped engaging hole 25 is formed above the hook portion 24 of the connecting portion 22.

When the cup receiving portions 21 are pressed from the side, the connecting portion 22 is elastically deformed and thus the two cup receiving portions 21 are folded back on each other. At this time, as shown in FIGS. 2(*a*), 2(*b*) and 2(*c*), a part of the flange portion 21B of the two cup receiving portions 21 is brought into contact with the other part of the flange portion 21B in accordance with the shape of the connecting portion 22 and a gap gradually increasing toward the upper side is formed between the two cup receiving portions 21.

By using a washable material, for example, a synthetic resin material, the soft net bag 30 is formed in a three-dimensional net shape similar to a three-dimensional shape of the brassiere holder 20 when the cup receiving portions 21 are folded back on each other. The soft net bag 30 is opened and closed by a fastener 31.

Figure 3:
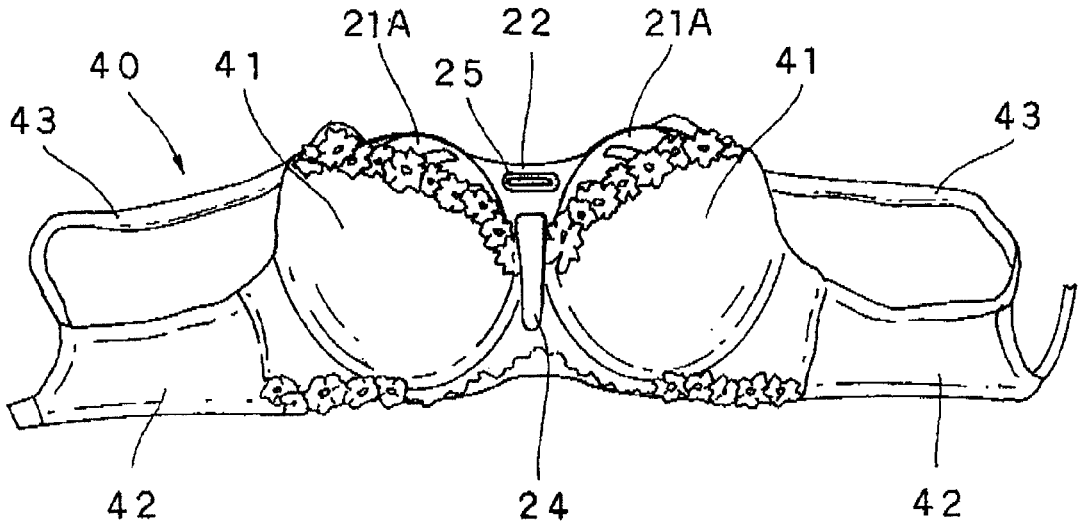
FIG. 3 is a perspective view illustrating a state in which a brassiere is covered with the holder in the embodiment.

For example, in washing of the brassiere 40, as shown in FIG. 3, the cup portions 41 of the brassiere 40 are covered with the cup receiving portions 21 of the brassiere holder 20, the lower peripheral edges of the cup portions 41 of the brassiere 40 are placed on the flange portion 21B of the cup receiving portions 21, and an area between the cup portions 41 is hooked by the hook portion 24 to position the cup portions 41 of the brassiere 40 with respect to the cup receiving portions 21.

Figure 2:
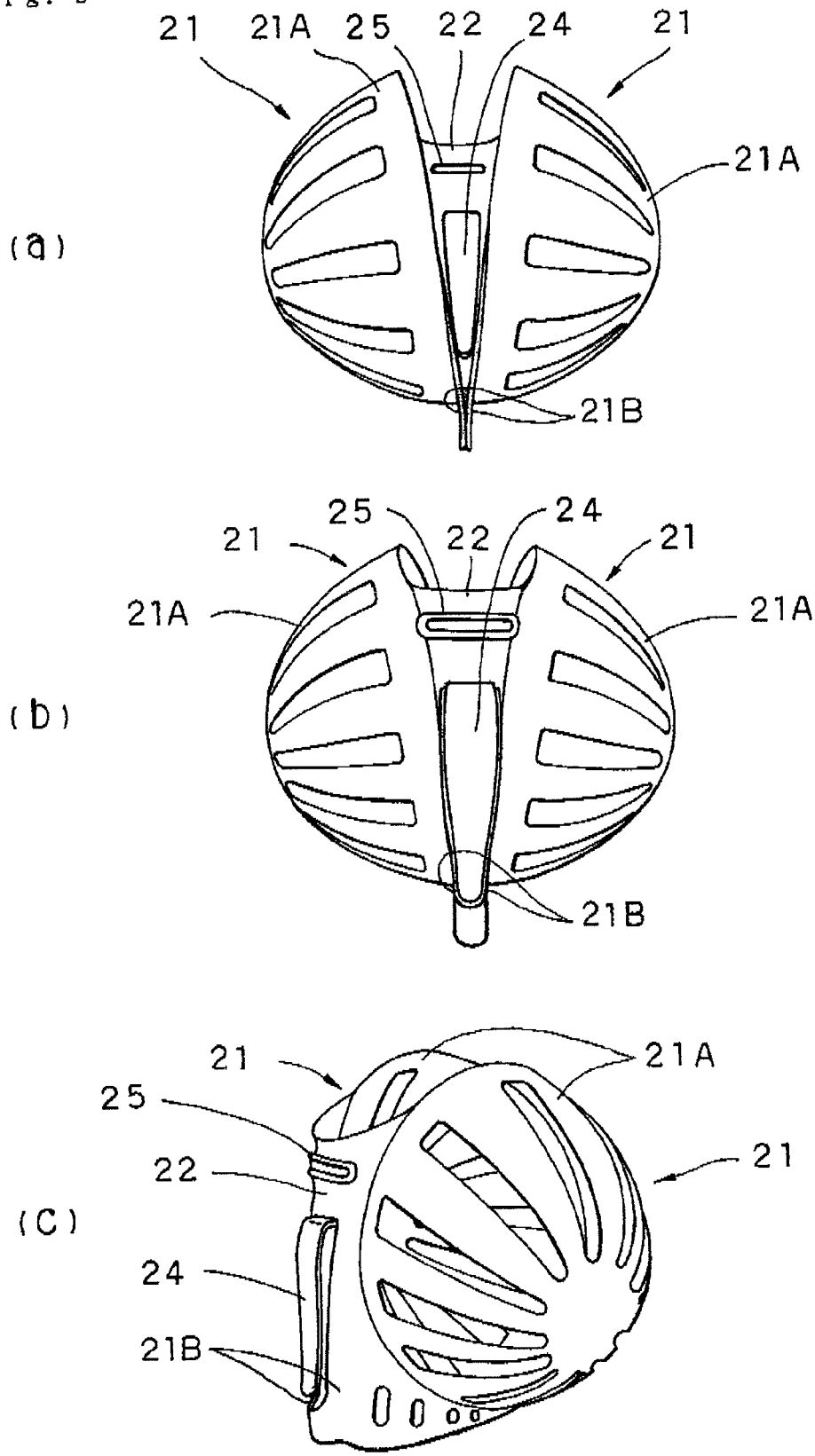
FIG. 2 is a view illustrating a state in which the holder is folded into two in the embodiment.
Figure 4:
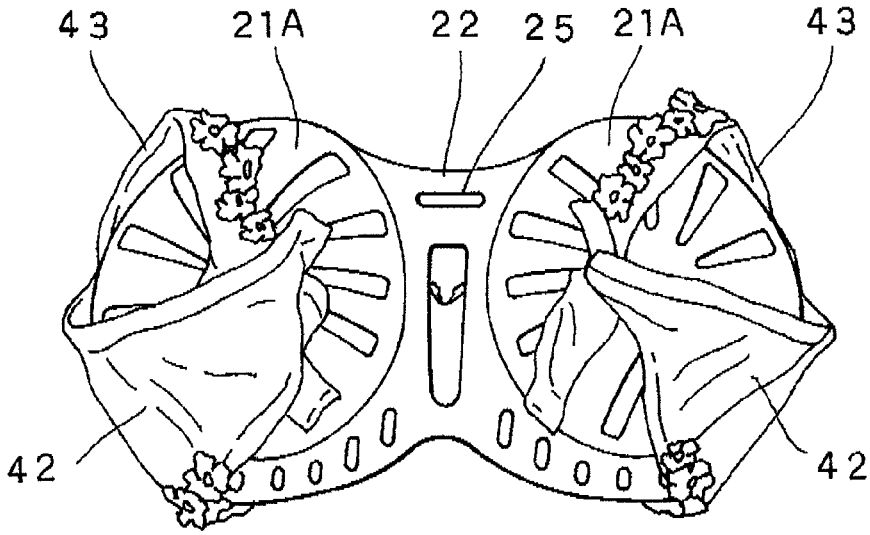
FIG. 4 is a back view illustrating a state in which under-belts and shoulder strips of the brassiere are accommodated inside cup receiving portions in the embodiment.
Figure 5:
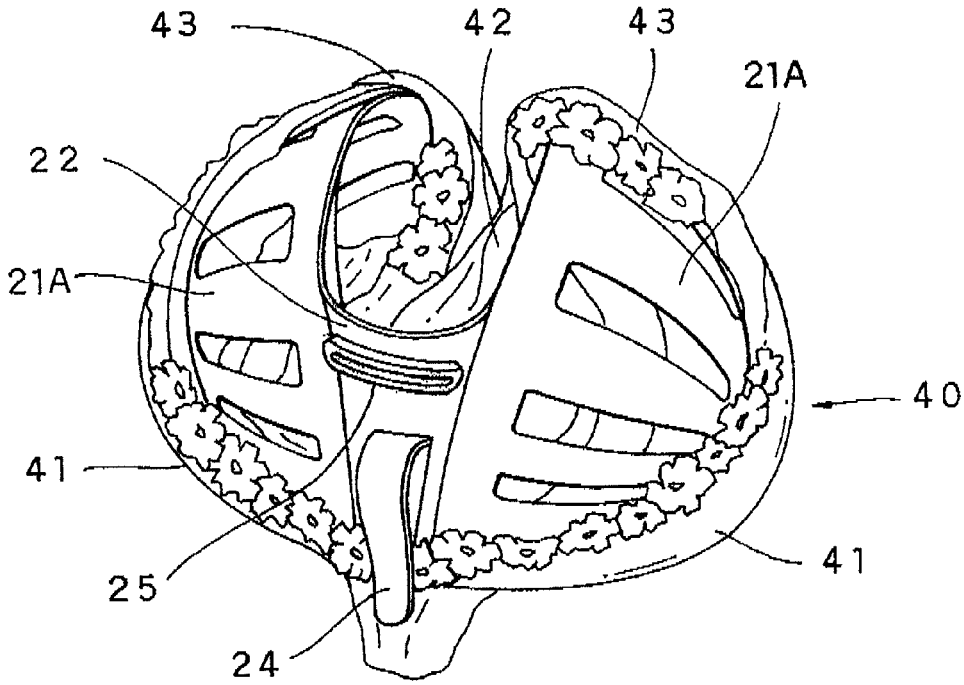
FIG. 5 is a perspective view illustrating a state in which the holder covering the brassiere is folded into two in the embodiment, as viewed from the front side.
Figure 6:
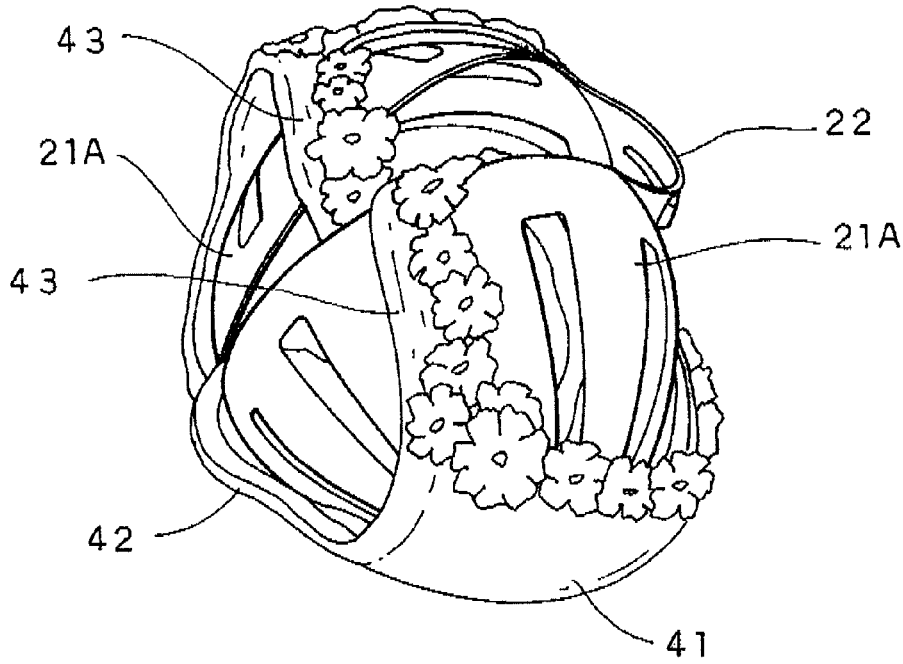
FIG. 6 is a perspective view illustrating a state in which the holder covering the brassiere is folded into two in the embodiment, as viewed from the back side.

Next, as shown in FIG. 4, when under-belts 42 and shoulder strips 43 of the brassiere 40 are put inside the cup receiving portions 21 and the left and right cup receiving portions 21 are pressed from the side, the connecting portion 22 is elastically deformed and thus the two cup receiving portions 21 are folded back on each other as shown in FIG. 5, and a part of the flange portion 21B of the two cup receiving portions 21 is brought into contact with the other part of the flange portion 21B and a gap gradually increasing toward the upper side is formed between the two cup receiving portions 21 as shown in FIGS. 2(*a*), 2(*b*) and 2(*c*).

Since the brassiere holder 20 as folded is formed in a three-dimensional shape similar to a shape obtained in a state in which a three-dimensional outer shape of a breast of a woman being is folded into two at the center, the cup portions 41 of the brassiere 40 are accurately fitted to the cup receiving portions 21 of the brassiere holder 20 while keeping the three-dimensional shapes thereof and are positioned by the hook portion 24 as they are under their current state, and the under-belts 42 and the shoulder strips 43 of the brassiere 40 are accommodated inside the folded cup receiving portions 21A.

Figure 7:
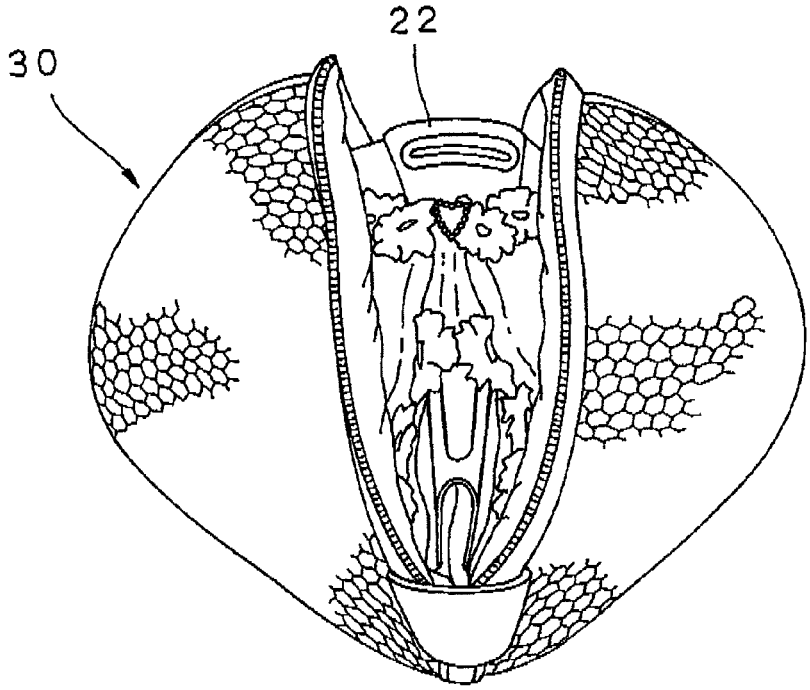
FIG. 7 is a perspective view illustrating a state in which the holder covering the brassiere and folded into two is accommodated inside the soft net bag in the embodiment.
Figure 8:
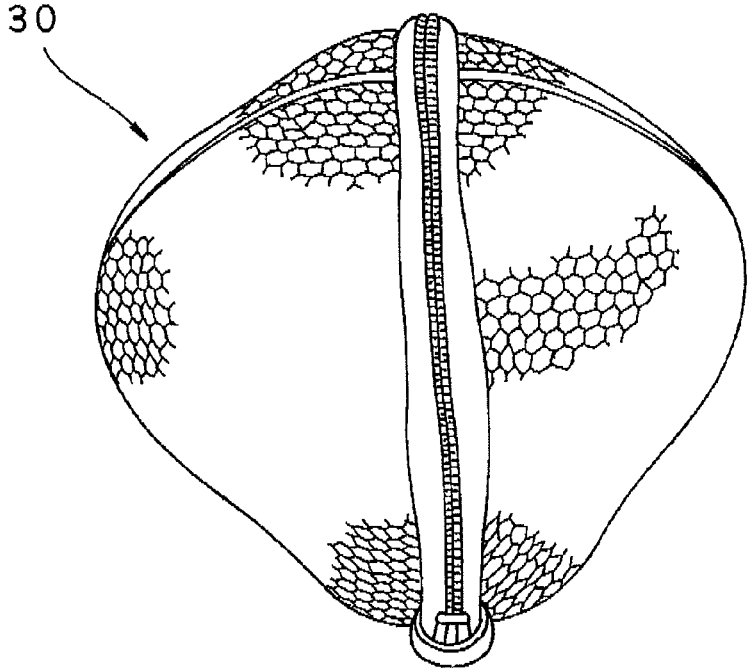
FIG. 8 is a perspective view illustrating the soft net bag with a closed fastener in the embodiment.

When the brassiere holder 20 holding the brassiere 40 in this manner is put in the soft net bag 30 while being pressed by hand so as to be maintained in a folded state thereof and then the hand is released, as shown in FIG. 7, the two cup receiving portions 21 are to return to their original state by an elastic restorative force of the connecting portion 22 and the cup portions 41 of the brassiere 40 are elastically held between the soft net bag 30 and the cup receiving portions 21. Accordingly, the three-dimensional shapes of the cup portions 41 of the brassiere 40 are kept and the shapes of wires inserted into the lower peripheral edges of the cup portions 41 of the brassiere 40 are also kept.

Finally, when the fastener 31 is pulled to close the soft net bag 30, the three-dimensional shape of the brassiere 40 is kept and displacement of the brassiere 40 does not occur even if an exterior force acts. When the brassiere is put in a washing machine and then washed, an exterior force generated by the flow of water acts on the brassiere 40 in the soft net bag 30. However, since the three-dimensional shape of the brassiere 40 is kept, loss of shape in the cup portions 41 and deformation and twisting of the wires do not occur.

Further, since the brassiere 40 is kept by the brassiere holder 20 in a shape similar to a three-dimensional shape obtained by folding a three-dimensional outer shape of a breast of a human being into two and an excessively high load is not applied to the cup portions 41, flexible and delicate fabric for the brassiere 40 is not damaged.

Figure 9:
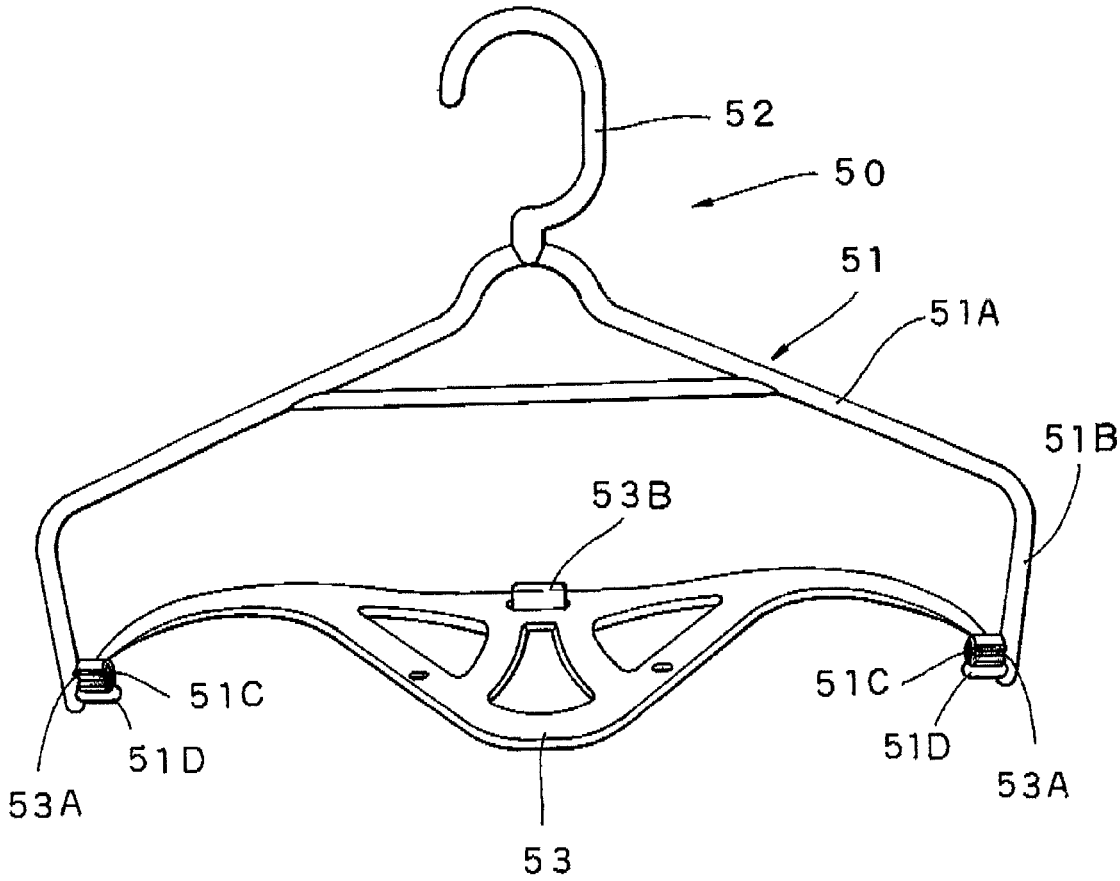
FIG. 9 is a perspective view schematically illustrating a hanger which is used by being combined with the holder.
Figure 10:
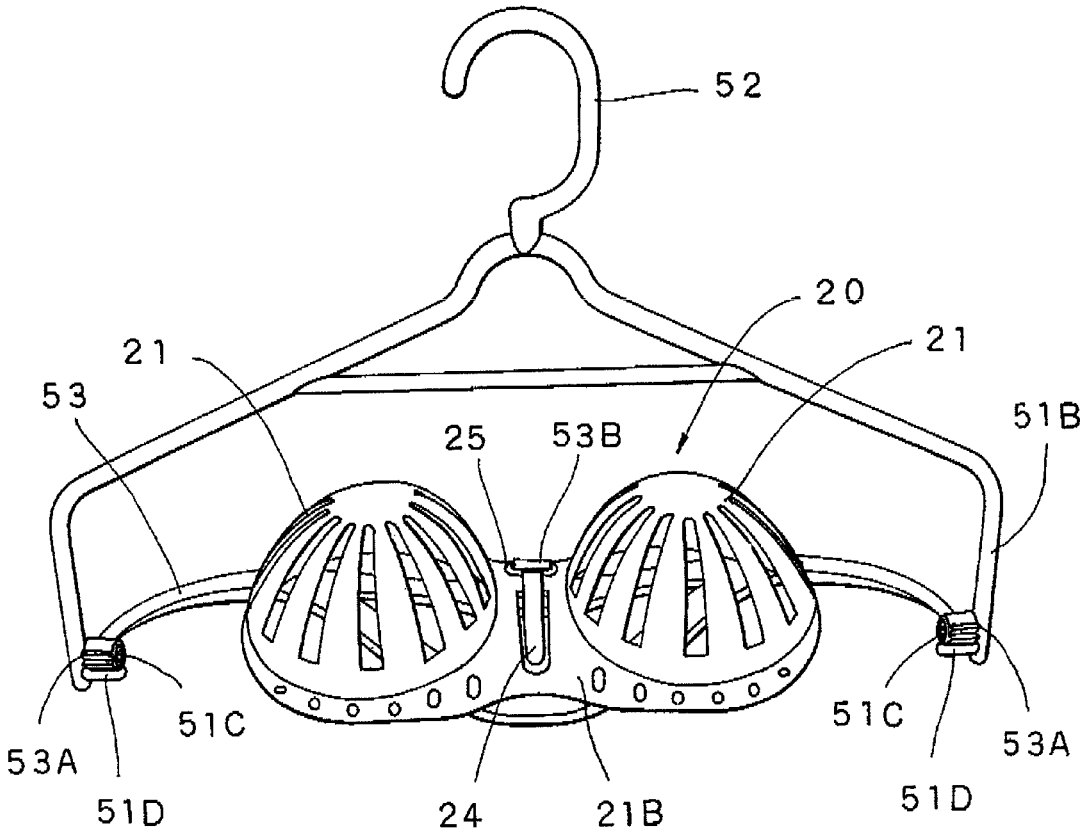
FIG. 10 is a view illustrating a state in which the holder is mounted on the hanger.
Figure 11:
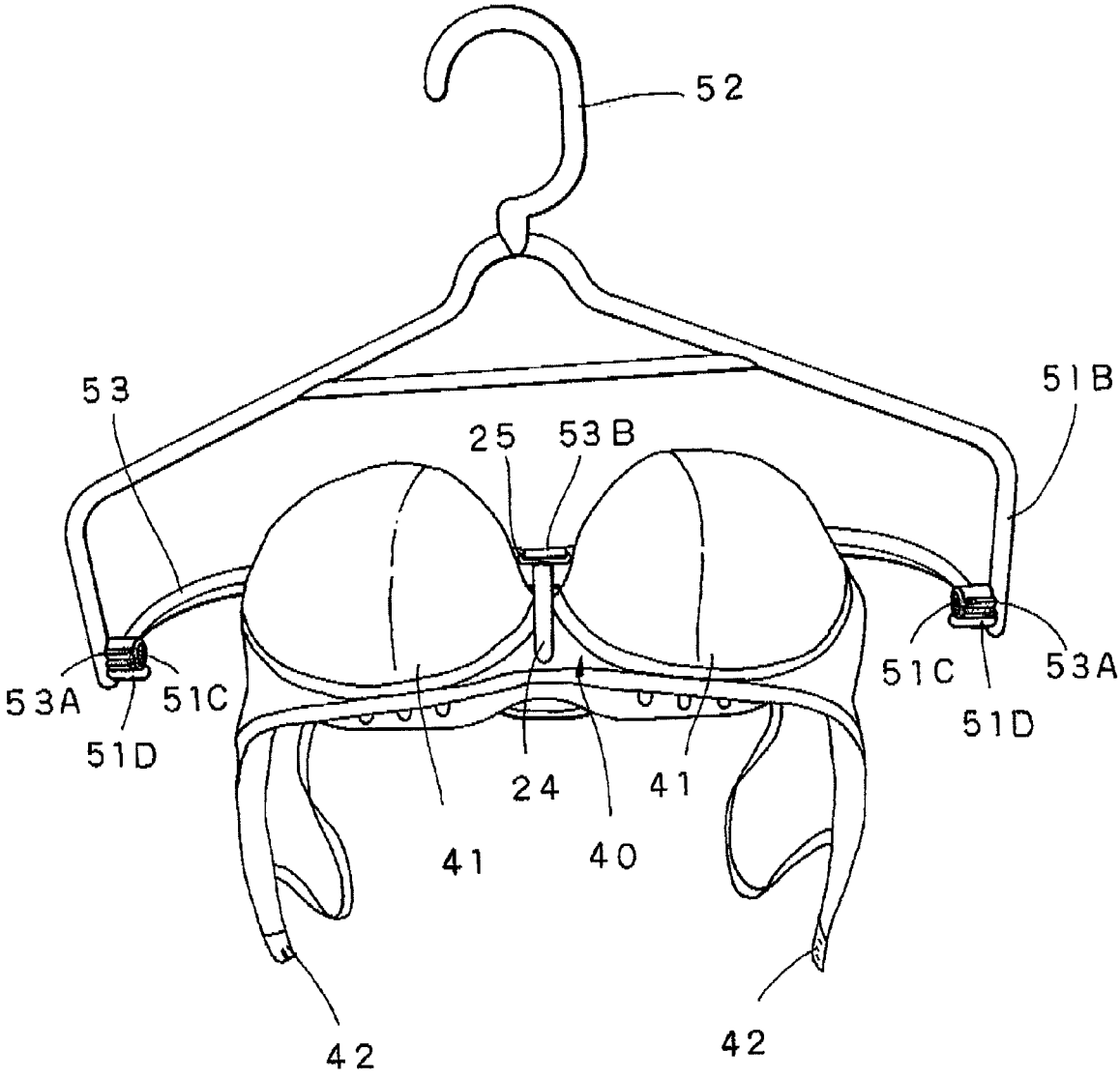
FIG. 11 is a view illustrating a state in which the brassiere is covered with the holder.

FIGS. 9 to 11 illustrate an example of a hanger 50 which is used by being combined with the brassiere holder 20. The hanger 50 is made of, for example, a plastic material and is configured by a hanger main body 51 and a receiving arm 53.

The hanger main body 51 is formed in a shape in which vertical side portions (both side portions) 51B are formed continuously downward from outer ends of left and right inclined side portions 51A and mounting pins 51C and 51D protrude inward from the lower end portions of the vertical side portions 51B. A hook 52 is formed at the top of the hanger main body 51.

The receiving arm 53 is formed in a mountain shape and has pin receivers 53A formed at both ends thereof. The pin receivers 53A are rotatably and externally fitted to the mounting pins 51C.

Uneven portions are formed on outer surfaces of the pin receivers 53A and engage with the lower mounting pins 51D to maintain the receiving arm 53 to a state parallel or perpendicular to the hanger main body 51.

An engaging protrusion 53B is formed at the center of the receiving arm 53 and the engaging hole 25 of the holder 20 engages with the engaging protrusion 53B so as to mount the holder 20 on the receiving arm 53.

When the washed brassiere 40 is dried, as shown in FIG. 11, the receiving arm 53 of the hanger 50 is rotated to be substantially perpendicular to the hanger body 51 to thereby engage the uneven portions of the pin receivers 53A with the mounting pins 51C. In this manner, the brassiere 40 is held.

Next, the cup portions 41 of the brassiere 40 are covered with the two bowl-shaped portions 21 so as to be positioned by the hook portion 24 and the under-belts 42 and the shoulder strips of the brassiere 40 are hung downward from recessed portions of the receiving arm 53. Then, the hook 52 of the hanger 50 may be hooked on a clothespole or clothesline and the brassiere 40 is rapidly dried by sunlight and the flow of air.

At this time, when the main body 51 of the hanger 50 is covered with, for example, a T-shirt, the brassiere 40 can be blinded from the surrounds and a woman can dry the brassiere 40 without feeling psychological burden.

Further, when the washed T-shirt is hung on the hanger 50, a breast portion and a back portion of the T-shirt closely cling to each other and thus air does not flow in the T-shirt and drying may become difficult to perform. However, in this example, the two bowl-shaped portions 21 are mounted such that raised portions thereof face the upper side and thus a space is formed between the breath portion and the back portion of the T-shirt and air smoothly flows into the T-shirt. Consequently, drying can be rapidly performed.

In drying of the brassiere 40, since the cup portions 41 of the brassiere 40 are dried in a state in which loss of shape is suppressed by the cup receiving portions 21, the brassiere 40 is removed from the hanger 50 while being fixed to the brassiere holder 20 and is stored or carried for a trip while being held by the brassiere holder 20.

When a space for storage and accommodation is sufficiently large, the brassiere holder 20 holding the brassiere 40 can be folded as it is and can be put in the soft net bag 30 so as to be stored and carried therein by closing the fastener 31. When being stored and carried, a plurality of the brassieres 40 can be held by one holder 20.

When the hanger 50 is used to dry clothing other than the brassiere 40, the receiving arm 53 is rotated so as to be parallel to the hanger main body 51. In this manner, the hanger 50 can be used like a normal hanger.

What is claimed is:

1. A brassiere washing utensil capable of keeping a shape of a brassiere during washing, the brassiere washing utensil comprising:

a brassiere holder;

a soft net bag, and a hanger;

wherein the brassiere holder includes 1) two cup receiving portions which are made of a soft and elastic restorative material in a bowl shape and have a hole or a slit formed in the bowl-shaped portions and for applying air and water permeabilities and a flange portion formed at lower peripheral edges of the bowl-shaped portions, cup portions of the brassiere are being covered with the bowl-shaped portions, the lower peripheral edges of the cup portions being received by the flange portion, and shoulder strips and under-belts of the brassiere being accommodated inside the bowl-shaped portions;

2) a connecting portion which connects the two cup receiving portions to each other and is elastically deformed by a pressing force from the side to allow the two cup receiving portions to be folded back on each other such that a part of the flange portion of the two cup receiving portions is brought into contact with the other part of the flange portion and a gap gradually increasing toward the upper side is formed between the two cup receiving portions; and 3) a hook portion which is formed in the connecting portion and hooks the brassiere to position the cup portions of the brassiere with respect to the cup receiving portions, and wherein the soft net bag is formed in a net shape made of a washable material, accommodates the holder in which the two cup receiving portions are folded back on each other, and elastically holds the cup portions of the brassiere in a gap with the bowl-shaped portions by an elastic restorative force of the bowl-shaped portions of the cup receiving portions to keep three-dimensional shapes of the cup portions of the brassiere and wires disposed in the lower peripheral edges of the cup portions of the brassiere;

wherein the hanger having a configuration in which both end portions of a receiving arm are rotatably supported to both side portions of a hanger main body, wherein an engaging hole is formed in the connecting portion of the brassier holder and an engaging protrusion capable of being fitted to the engaging hole of the brassiere holder is formed in the receiving arm.

2. The brassiere washing utensil according to claim 1, wherein the soft net bag is formed in a three-dimensional shape similar to a three-dimensional shape of the holder when the cup receiving portions are folded back on each other, and can be opened and closed by a fastener.

3. The brassiere washing utensil according to claim 1, wherein both the end portions of the receiving arm are provided such that the two cup receiving portions of the holder are held so as to face the upper side.

* * * * *